US008210385B1

(12) United States Patent
Zurek et al.

(10) Patent No.: US 8,210,385 B1
(45) Date of Patent: Jul. 3, 2012

(54) CONTAINER LID RETAINING SYSTEM

(76) Inventors: Lawrence A. Zurek, Warren, MI (US); Eric C. Myers, Ann Arbor, MI (US)

( * ) Notice: Subject to any disclaimer, the term of this patent is extended or adjusted under 35 U.S.C. 154(b) by 261 days.

(21) Appl. No.: 12/625,638

(22) Filed: Nov. 25, 2009

(51) Int. Cl.
*B65D 55/16* (2006.01)

(52) U.S. Cl. ..... 220/375; 220/296; 220/694; 220/754; 220/770; 220/908; 206/459.5; 215/306

(58) Field of Classification Search ..... 220/375, 220/296, 694, 754, 770, 775, 908; 215/306; 206/459.5
See application file for complete search history.

(56) References Cited

U.S. PATENT DOCUMENTS

| | | | | |
|---|---|---|---|---|
| 3,158,393 | A | 11/1964 | King | |
| 3,291,515 | A | 12/1966 | Lierman | |
| 3,363,924 | A | 1/1968 | Remig | |
| 3,980,202 | A | 9/1976 | Monyak et al. | |
| 4,339,056 | A * | 7/1982 | Berkstresser et al. | 220/375 |
| 4,545,501 | A | 10/1985 | DeFord | |
| 5,078,295 | A | 1/1992 | Grant | |
| D333,715 | S | 3/1993 | Mahler | |
| 5,297,692 | A | 3/1994 | Kronmiller | |
| 6,041,960 | A | 3/2000 | Leal | |
| 2004/0031806 | A1 * | 2/2004 | Jackson | 220/754 |
| 2004/0065666 | A1 | 4/2004 | Walker | |

* cited by examiner

*Primary Examiner* — Anthony Stashick
*Assistant Examiner* — Elizabeth Volz

(57) ABSTRACT

A container lid retaining system includes a housing with a bottom wall and a perimeter wall attached to and extending upwardly from the bottom wall. The perimeter wall has an upper edge defining an opening extending into the housing. A cover is removably positioned on the perimeter wall to selectively close the opening. A flexible tether has a first end and a second end. The tether extends through the perimeter wall adjacent to the upper edge to position the first end within the housing. The tether extends through the cover to position the second end under the cover when the cover is positioned on the housing. A panel is attached to the first end to prevent the first end from is pulled through the perimeter wall. A stop is removably coupled to the tether adjacent to the second end to prevent the second end from being pulled through the cover.

9 Claims, 3 Drawing Sheets

CONTAINER LID RETAINING SYSTEM

BACKGROUND OF THE DISCLOSURE

Field of the Disclosure

The disclosure relates to covering coupler devices and more particularly pertains to a new covering coupler device for retaining a trash receptacle's cover in connection with the trash receptacle.

SUMMARY OF THE DISCLOSURE

An embodiment of the disclosure meets the needs presented above by generally comprising a housing that has a bottom wall and a perimeter wall attached to and extending upwardly from the bottom wall. The perimeter wall has an upper edge defining an opening extending into the housing. A cover is removably positioned on the perimeter wall to selectively close the opening. A flexible tether has a first end and a second end. The tether extends through the perimeter wall adjacent to the upper edge to position the first end within the housing. The tether extends through the cover to position the second end under the cover when the cover is positioned on the housing. A panel is attached to the first end to prevent the first end from is pulled through the perimeter wall. A stop is removably coupled to the tether adjacent to the second end to prevent the second end from being pulled through the cover.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
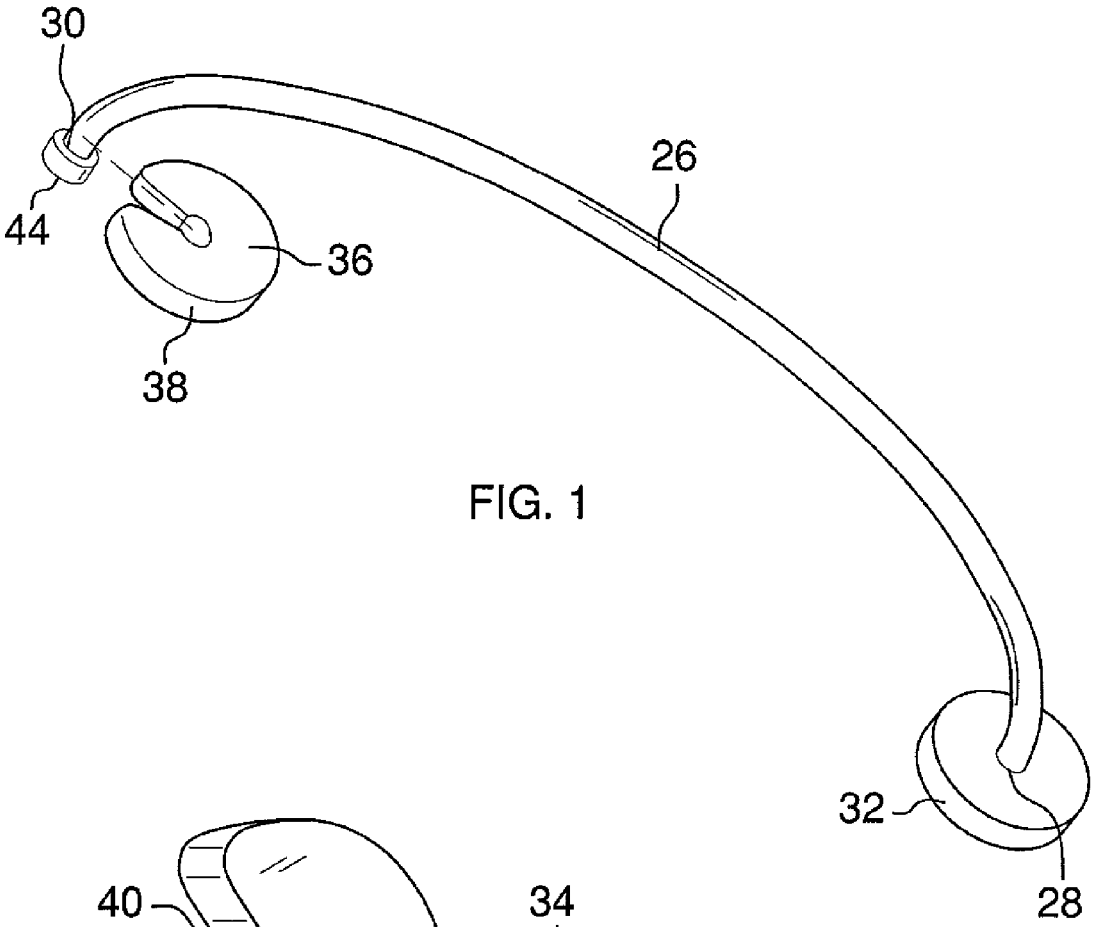
FIG. 1 is a perspective view of a container lid retaining system according to an embodiment of the disclosure.
Figure 2:
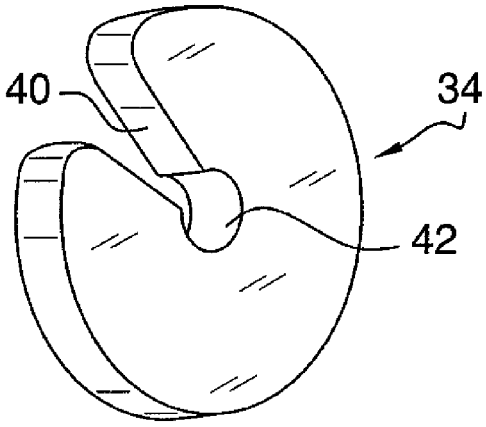
FIG. 2 is a perspective view of a stop of an embodiment of the disclosure.

With reference now to the drawings, and in particular to FIGS. 1 through 6 thereof, a new covering coupler device embodying the principles and concepts of an embodiment of the disclosure and generally designated by the reference numeral 10 will be described.

As best illustrated in FIGS. 1 through 6, the container lid retaining system 10 generally comprises a housing 12 that has a bottom wall 14 and a perimeter wall 16 that is attached to and extends upwardly from the bottom wall 14. The perimeter wall 16 has an upper edge 18 defining an opening 20 extending into the housing 12. A cover 22 is removably positioned on the perimeter wall 16 to selectively close the opening 20. A grip 24 is attached to the cover 22.

A flexible tether 26 has a first end 28 and a second end 30. The tether 26 extends through the perimeter wall 16 adjacent to the upper edge 18 to position the first end 28 within the housing 12. The tether 26 extends through the cover 22 to position the second end 30 under the cover 22 when the cover 22 is positioned on the housing 12.

A panel 32 is attached to the first end 28 to prevent the first end 28 from being pulled through the perimeter wall. The panel 32 is non-removably coupled to the tether 26.

Figure 3:
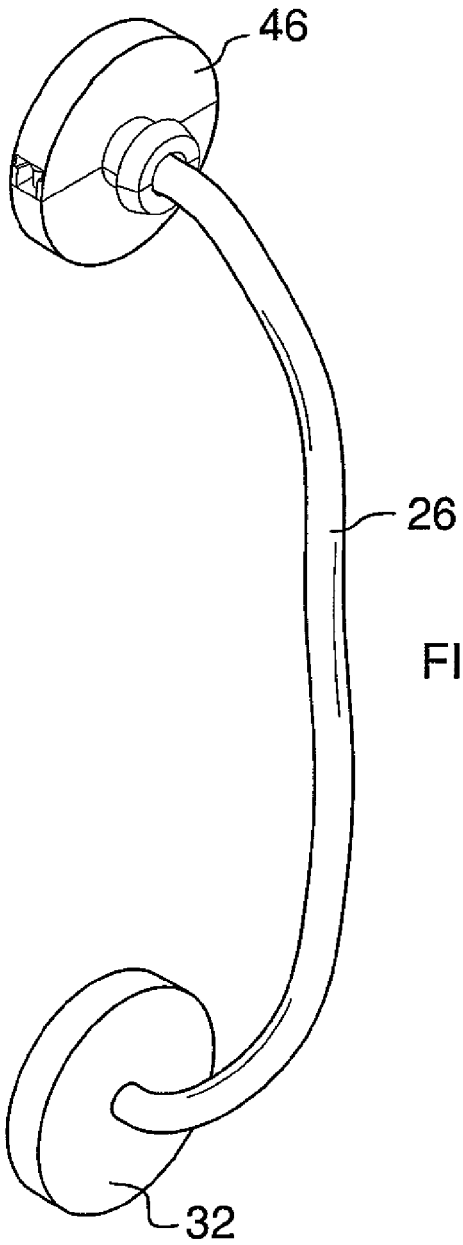
FIG. 3 is a perspective view of an embodiment of the disclosure.
Figure 4:
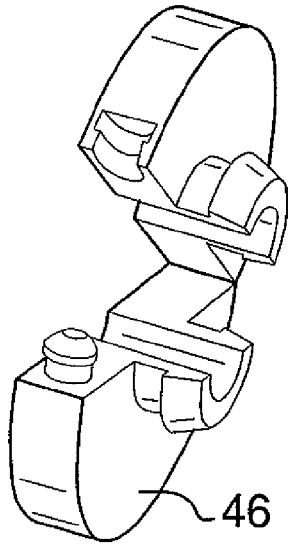
FIG. 4 is a perspective view of an embodiment of the disclosure.
Figure 5:
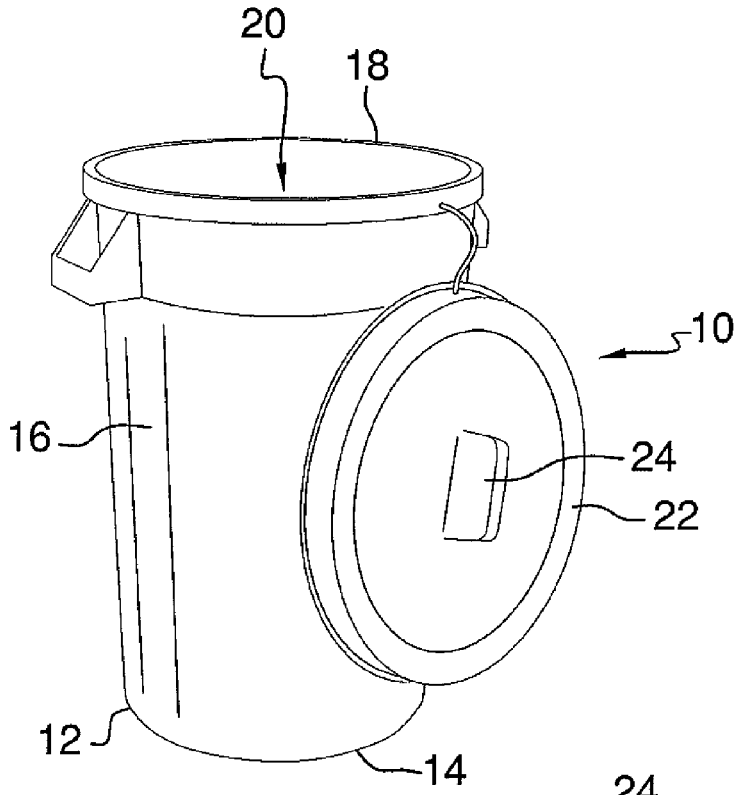
FIG. 5 is a perspective in-use view of an embodiment of the disclosure.
Figure 6:
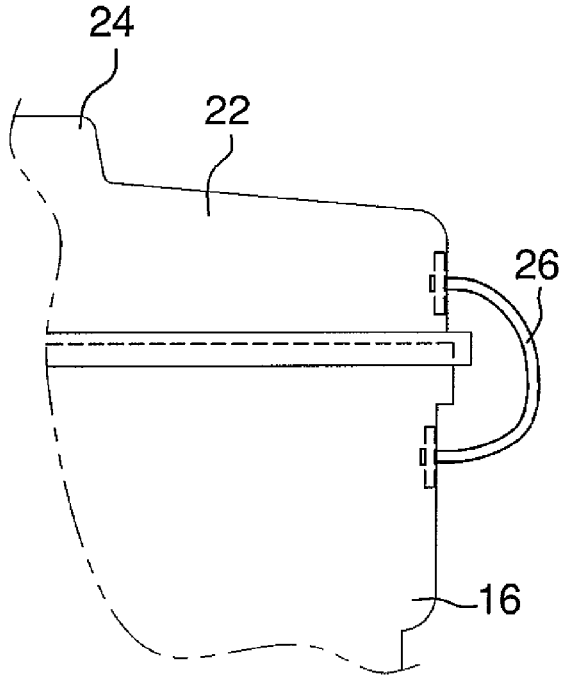
FIG. 6 is a broken side view of an embodiment of the disclosure.

A stop 34 is removably coupled to the tether 26 adjacent to the second end 30 to prevent the second end 30 from being pulled through the cover 22. The stop 34 includes a plate 36 has a perimeter edge 38 with a slit 40 extending therein. The tether 26 is removably moved through the slit 40. The slit 40 has a terminal end forming a notch 42. The tether 26 is positionable in the notch 42. The second end 30 of the tether 26 has a bulbous member 44 attached thereto to prevent the second end 30 from being pulled through the notch 42. Alternatively, the stop 34 may include a clamp 46 which is removably clamped onto the tether 26 as shown in FIGS. 3 and 4.

In use, the tether 26 is extended through the cover 22 and the housing 12 to couple the cover 22 and the housing 12 together. This will prevent the cover 22 from blowing off of or otherwise being lost. The stop 34 can be removed as needed to remove the tether 26 from the cover 22 and the housing 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. A container and covering connecting system comprising:

a housing having a bottom wall and a perimeter wall being attached to and extending upwardly from said bottom wall, said perimeter wall having an upper edge defining an opening extending into said housing;

a cover being removably positioned on said perimeter wall to selectively close said opening;

a flexible tether having a first end and a second end, said tether extending through said perimeter wall adjacent to said upper edge to position said first end within said housing, said tether extending through said cover to position said second end under said cover when said cover is positioned on said housing;

a panel being attached to said first end to prevent said first end from being pulled through said perimeter wall; and a stop being removably coupled to said tether adjacent to said second end to prevent said second end from being pulled through said cover.

2. The system according to claim 1, wherein said panel is non-removably coupled to said tether.

3. The system according to claim 1, wherein said stop includes a plate having a perimeter edge with a slit extending therein, said tether being removably moved through said slit, said slit having a terminal end forming a notch, said tether being positionable in said notch, said second end of said tether having a bulbous member thereon to prevent said second end from being pulled through said notch.

4. The system according to claim 1, wherein said stop including a clamp being removably clamped onto said tether adjacent to said second end, said second end of said tether having a bulbous member attached thereto to prevent said second end from being pulled through said clamp.

5. A container and covering connecting system comprising:

a housing having a bottom wall and a perimeter wall being attached to and extending upwardly from said bottom wall, said perimeter wall having an upper edge defining an opening extending into said housing;

a cover being removably positioned on said perimeter wall to selectively close said opening, a grip being attached to said cover;

a flexible tether having a first end and a second end, said tether extending through said perimeter wall adjacent to said upper edge to position said first end within said housing, said tether extending through said cover to position said second end under said cover when said cover is positioned on said housing;

a panel being attached to said first end to prevent said first end from being pulled through said perimeter wall, said panel being non-removably coupled to said tether; and a stop being removably coupled to said tether adjacent to said second end to prevent said second end from being pulled through said cover, said stop including a plate having a perimeter edge with a slit extending therein, said tether being removably moved through said slit, said slit having a terminal end forming a notch, said tether being positionable in said notch, said second end of said tether having a bulbous member attached thereto to prevent said second end from being pulled through said notch.

6. A container and covering connecting system comprising:

a trash receptacle including a housing and a cover;

a flexible tether having a first end and a second end, said tether extending through said housing and said cover such that said first and second ends are positioned within said trash receptacle when said cover is positioned on said housing;

a panel being attached to said first end to prevent said first end from being pulled through said trash receptacle, said panel having first side and a second side, said first end extending into said first side and outwardly of said second side, said first side being planar; and a stop being removably coupled to said tether adjacent to said second end to prevent said second end from being pulled through said trash receptacle, said stop being movable with respect to said trash receptacle.

7. The system according to claim 6, wherein said panel is non-removably coupled to said tether.

8. The system according to claim 6, wherein said stop includes a plate having a perimeter edge with a slit extending therein, said tether being removably moved through said slit, said slit having a terminal end forming a notch, said tether being positionable in said notch, said second end of said tether having a bulbous member thereon to prevent said second end from being pulled through said notch.

9. The system according to claim 6, wherein said stop including a clamp being removably clamped onto said tether adjacent to said second end, said second end of said tether having a bulbous member attached thereto to prevent said second end from being pulled through said clamp.

* * * * *